US005632447A

United States Patent [19]

Christ

[11] Patent Number: 5,632,447

[45] Date of Patent: May 27, 1997

[54] FUEL INJECTION NOZZLE FOR INTERNAL COMBUSTION ENGINES

[75] Inventor: Wilhelm Christ, Ludwigsburg, Germany

[73] Assignee: Robert Bosch GmbH, Stuttgart, Germany

[21] Appl. No.: 500,898

[22] PCT Filed: Nov. 24, 1994

[86] PCT No.: PCT/DE94/01386

§ 371 Date: Aug. 1, 1995

§ 102(e) Date: Aug. 1, 1995

[87] PCT Pub. No.: WO95/15435

PCT Pub. Date: Jun. 8, 1995

[30] Foreign Application Priority Data

Dec. 1, 1993 [DE] Germany ..... 43 40 874.5

[51] Int. Cl.[6] ..... F02M 45/00

[52] U.S. Cl. ..... 239/533.4

[58] Field of Search ..... 239/533.3–533.12

[56] References Cited

U.S. PATENT DOCUMENTS

| | | | |
|---|---|---|---|
| 4,359,191 | 11/1982 | Uchida | 239/533.9 X |
| 4,768,719 | 9/1988 | Straubel et al. | 239/533.4 |
| 4,962,890 | 10/1990 | Shindo et al. | 239/533.4 |

FOREIGN PATENT DOCUMENTS

| | | | |
|---|---|---|---|
| 239259 | 2/1987 | European Pat. Off. . | |
| 360130 | 3/1990 | European Pat. Off. . | |
| 459676 | 4/1991 | European Pat. Off. . | |
| 866574 | 6/1952 | Germany | 239/533.4 |
| 3928912 | 4/1990 | Germany . | |

*Primary Examiner*—Kevin Weldon

*Attorney, Agent, or Firm*—Edwin E. Greigg; Ronald E. Greigg

[57] ABSTRACT

A fuel injection nozzle for preinjection and main injection has a nozzle holder in which two closing springs are arranged coaxially, one spring acts continuously on the valve needle via a central pressure bolt and the other spring acts on the valve needle, via a pressure ring surrounding the pressure bolt, once the valve needle has passed through a pretravel ($h_v$). Between the valve needle and the pressure bolt and the pressure ring, an intermediate pressure element which is constructed as a disk is arranged, the outer edge area of the intermediate pressure element does not come into contact with the pressure ring until after the valve needle has passed through the pretravel ($h_v$), which pressure is supported in the closed position of the valve needle by a shoulder of an intermediate disk. In order to prevent the connection between the low pressure space at the valve needle and the pressure-relieved spring chamber being interrupted in the pretravel position when the intermediate pressure element comes into axial contact with the pressure ring which is supported on the shoulder of the intermediate disk, bridging channels are arranged at least in the intermediate pressure element.

5 Claims, 2 Drawing Sheets

FUEL INJECTION NOZZLE FOR INTERNAL COMBUSTION ENGINES

PRIOR ART

The invention is based on a fuel injection for internal combustion engines nozzle. In an injection nozzle of this kind which is known for example from EP 0 568 845 A1, the leakage oil emerging from the guide play of the valve needle in the nozzle body flows through the opening in the intermediate disk into the spring chamber in the nozzle holder, which spring chamber is connected by means of a connecting stub to a leakage oil return line. In this process, in the region of the intermediate disk it passes through the axial guide play between the intermediate pressure element and the axial play between the pressure bolt of the first closing spring and the pressure ring, surrounding the said pressure bolt, of the second closing spring. In this known pressure transmission device of the injection nozzle, damping of the movement of the valve needle in its pretravel position occurs when the intermediate pressure element is in contact with its edge region with the pressure ring of the second closing spring and the latter is simultaneously in contact with its end side with the intermediate pressure disk. By means of the interruption, which is produced in this process, in the connection between the low pressure side of the valve needle and the pressure-relieved spring chamber, the opening and closing characteristic of the fuel injection nozzle is changed by damping as a result of the build up of pressure on the low pressure side. In the pretravel position of the valve needle, the space in the intermediate disk is in fact sealed off by the intermediate pressure disk so that the build up in pressure occurs there. Since the pressure surface of the intermediate pressure element is larger than the pressure surface of the valve needle, a force results which is opposed to the closing of the needle and which delays the closing. As a result, an entirely undesired emission of hydrocarbon occurs.

ADVANTAGES OF THE INVENTION

The fuel injection nozzle with the characterizing features of the invention has the advantage that rapid closing of the valve needle after the injection phase is ensured so that the emission behavior of the internal combustion engine is of a high standard. The proposed solution is cost-effective and operationally reliable.

By means of the measures disclosed claim 1 advantageous developments and improvements of the fuel injection nozzle specified in claim 1 are possible.

BRIEF DESCRIPTION OF THE DRAWINGS

Exemplary embodiments of the invention are illustrated in the drawing and are explained in greater detail below.

DETAILED DESCRIPTION OF THE EXEMPLARY EMBODIMENTS

Figure 1:
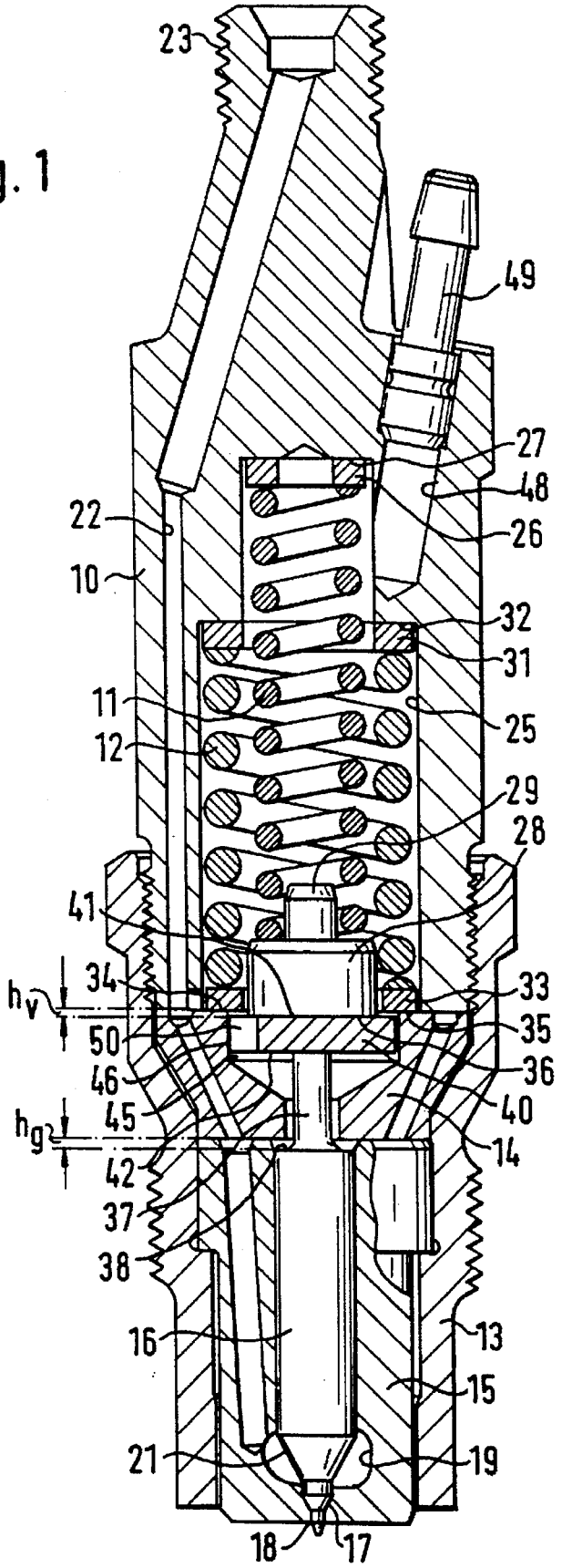
FIG. 1 shows, in longitudinal section, a fuel injection nozzle which opens in two pressure stages.

The fuel injection nozzle has a nozzle holder 10 on which a nozzle body 15 is clamped tightly with a union nut 13 over an intermediate disk 14. The nozzle body 15 has an injection opening 18 and a valve seat 17 which is mounted in front of the latter and with which a valve needle 16 which is displaceably mounted in the intermediate body 15 interacts. The guide hole for the valve needle 16 is widened, as is customary, at one point to form a pressure space 19 in the area of which the valve needle 16 has a pressure shoulder 21, which pressure space 19 is connected via a channel 22 to a stub and 23 on the nozzle holder 10 for the connection of a fuel feed line. The fuel pressure which acts on the pressure shoulder 21 of the valve needle 16 pushes the valve needle 16 upwards counter to the stepped force profile of the arrangement, described below, of closing springs 11 and 12, the fuel being ejected through the injection opening 18 into the combustion space in a preinjection phase determined by the first closing spring 11 and a main injection phase determined by the two closing springs 11, 12.

In the illustrated exemplary embodiment, the two closing springs 11, 12 are arranged radially one in the other in a stepped chamber 25 in the nozzle holder 10; however, they can also be arranged axially one behind the other, as is known per se. The inner, first closing spring 11 is supported on the one hand on the base 27 of the chamber 25 by means of a disk 26 and is supported on the other hand on a pressure bolt 28 which guides the first closing spring 11 with a pin 29 and the second closing spring 12 with its outer casing. The second, outer closing spring 12 is supported on the one hand on a shoulder 32 of the chamber 25 by means of a disk 31 and on the other hand on a shoulder 34, formed by the intermediate disk 14, by means of a pressure ring 33 surrounding the pressure bolt 28.

Figure 2:
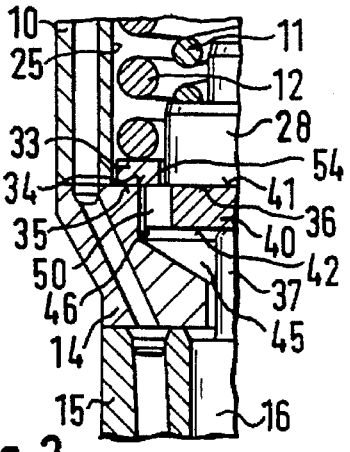
FIGS. 2 and 3 show a detail in the area of the pressure transmission device of the fuel injection nozzle according to FIG. 1 in the "pretravel" and "complete travel" positions.
Figure 3:
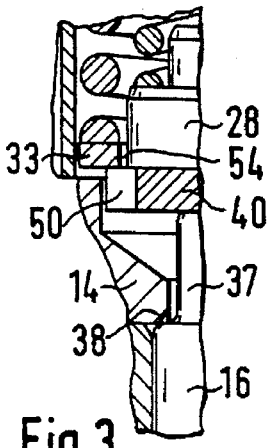
Figure 4:
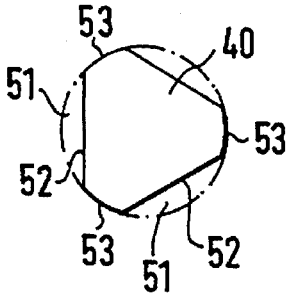
FIG. 4 shows an intermediate pressure element in plan view.

The pressure bolt 28 presses continuously, with its end side 36 which is of planar construction, on an intermediate pressure element 40 which is supported itself on an end pin 37 of the valve needle 16. This intermediate pressure element 40 is essentially in the shape of a disk with two plane-parallel end sides 41, 42. It is guided so as to be axially displaceable with movement play with its circumference in a widened portion 46 of an opening 45 in the intermediate disk 14 near to the chamber 25 of the nozzle holder 10. The diameter of the widened portion 46 and that of the intermediate pressure element 40 are larger than the internal diameter of the pressure ring 33 so that the edge area of the intermediate pressure element 40 is axially congruent with the inner annular area of the pressure ring 33. The thickness of the intermediate element 40 is dimensioned such that its upper side 41, in the closed position of the valve needle 16, lies, by the amount $h_v$, below the shoulder 34 of the intermediate disk 14 or the end side 35 of the pressure ring 33 which is supported thereon (FIG. 1). The pretravel $h_v$ of the valve needle 16 can be easily set by selecting an intermediate element 40 with the corresponding thickness. During the opening travel of the valve needle 16 during which the pretravel $h_v$ is initially passed through under the effect of only the first closing spring 11, the intermediate pressure element 40 comes into contact with the pressure ring 33 after passing through the pretravel distance, after which both closing springs 11 and 12 act on the valve needle 16 so as to form a pressure stage (FIG. 2). The entire travel $h_g$ of the valve needle 16 is, as is known, limited by the annular shoulder 38, formed at the transition to the end pin 37, of the valve needle 16 and the lower end side of the intermediate disk 14 (FIG. 3).

In order to avoid the hydraulic connection between the space which is divided off from the valve needle 15 by the intermediate pressure element 40 and the pressure-relieved spring chamber being interrupted in the pretravel position (FIG. 2) in which the pressure ring 33 rests under pressure in a sealing fashion with its lower end side 35 both on the shoulder 34 of the intermediate disk 14 and on the upper end side 41 of the intermediate pressure element 40, which spring chamber is connected via a hole 48 and a pressure connector 49 to a leakage-oil return line (not illustrated), at least one channel 50, which interrupts the closed bearing surface between the pressure ring 33 and the intermediate pressure element 40, is arranged in the intermediate pressure element 40 or in the pressure ring 30. The leakage oil which emerges under pressure from the guide play of the valve needle 16 can thus flow off past the circumference of the intermediate pressure ring 40 through the channel 50 and through the guide play 54 between the pressure ring 33 and the pressure bolt 28 into the pressure-relieved spring chamber 25.

The channels 50 in the intermediate pressure element 40 are formed in the exemplary embodiment according to FIGS. 1 to 4 by virtue of the fact that three edge sections 51 are removed uniformly distributed over the circumference of a cylindrical disk so that the circumference is composed of three radially set-back areas with a linear boundary face 52 and of three guide sections with arcuate boundary surface 53. By means of the areas, not covered by the edge sections 51, of the play gap 54 between the pressure ring 33 and the pressure bolt 28 there is a continuous connection between the low pressure side of the valve needle 16 and the pressure-relieved chamber 25.

Figure 5:
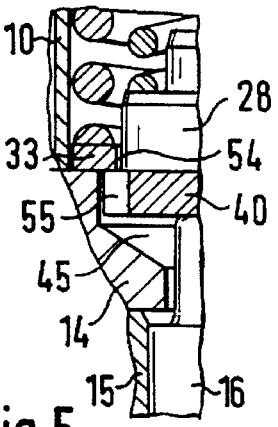
FIGS. 5 and 6, FIGS. 7 and 8 and FIGS. 9 and 10 show alternative embodiments of the intermediate pressure element in cross-section and in plan view
Figure 7:
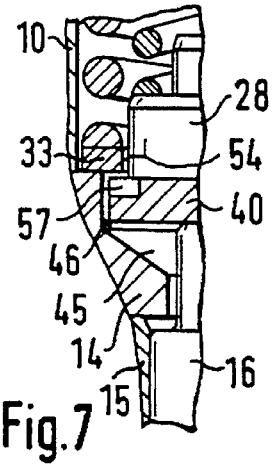
Figure 9:
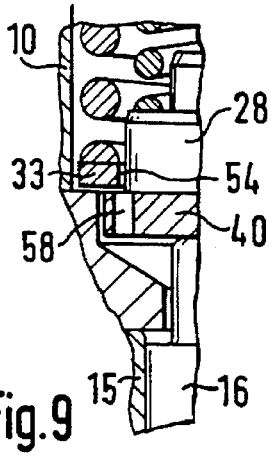
Figure 6:
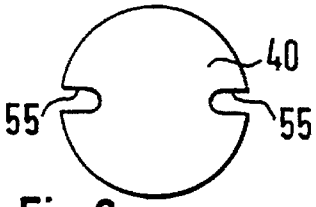
Figure 8:
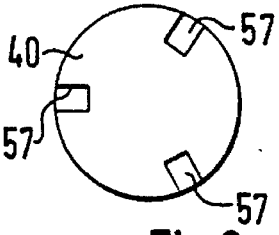
Figure 10:
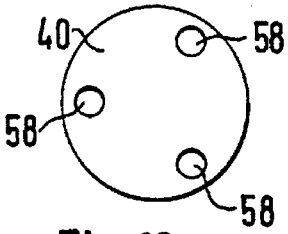

In the exemplary embodiment according to FIGS. 5 and 6, two indents 55 are arranged diametrically opposite one another in the circumference of the cylindrical intermediate pressure element 40, which indents 55 partially cover the play gap 54 between the pressure bolt 28 and the pressure ring 33. Instead of the indent 55, radial grooves 57, as shown by FIGS. 7 and 8, may be arranged in the intermediate pressure element 40 in the end side 41 which is in contact with the pressure bolt 28. With this configuration, leakage oil initially passes through the guide play between the circumference of the intermediate pressure element 40 and the widened portion 46 of the opening 45 in the intermediate disk 14, subsequently through the three grooves 57 and finally through the play gap 54. The channels 50 can also be formed, as shown by FIGS. 9 and 10, by openings in the form of holes 58 in the cylindrical intermediate pressure element 40, the longitudinal axis of which holes 58 is aligned essentially with the play gap 54.

Figure 11:
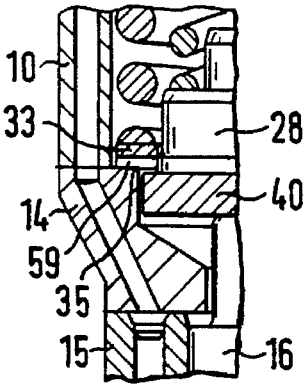
FIG. 11 shows a pressure transmission device of alternative design, in longitudinal section.

Instead of channels 50 in the intermediate pressure element 40, channels may also be arranged in the pressure ring 33. As is shown by FIG. 11, the pressure ring 33 has in its end side 35 facing the intermediate disk 14 and the intermediate pressure element 40 at least one recess, preferably in the form of a radial groove 59. The leakage oil which flows through the guide gap between the intermediate pressure element 40 and the widened portion 46 of the opening 45 in the intermediate disk 14 can flow off through the radial grooves 59 in the pressure ring 33 to the play gap 54 and to the guide gap between the wall of the chamber 55 and the outer circumference of the pressure ring 33. Other shapes of channels in the pressure ring 33 are possible. Finally, bridging channels may also be arranged in the shoulder 34 of the intermediate disk 14, as a result of which leakage oil flowing through the guide play of the intermediate pressure element 40 can flow off into the play gap between the inner wall of the chamber 25 and the outer circumference of the pressure ring 33. In addition, it is possible to arrange such bridging channels both in the intermediate pressure element 40 and in the pressure ring 33 and also in the shoulder 34 of the intermediate element 14.

The foregoing relates to preferred exemplary embodiments of the invention, it being understood that other variants and embodiments thereof are possible within the spirit and scope of the invention, the latter being defined by the appended claims.

I claim:

1. A fuel injection nozzle for preinjection and main injection in internal combustion engines, which comprises a nozzle body (15), a valve needle (16) displaceably mounted in said nozzle body along an axis of said injection nozzle and said nozzle body is clamped tightly on a nozzle holder (10) via an intermediate disk (14), a pressure-relieved spring chamber (25) is formed within said nozzle holder (10), said pressure-relieved spring chamber is connected to a leakage oil return line and has the purpose of receiving two coaxially arranged closing springs (11, 12) therein, the first closing spring (11) acts continuously on the valve needle (16) via a pressure bolt (28) and the second closing spring (12) presses against a pressure ring (33) which surrounds the pressure bolt (28) and, in a closed position of the valve needle (16), said pressure ring (33) is supported on a shoulder (34) formed on the intermediate disk (14), an opening (45) in said intermediate disk near said pressure relieved spring chamber forms a low pressure space which is open to the nozzle body (15) and the valve needle (16), an intermediate pressure element (40) in said opening (15), said intermediate pressure element is supported on an end pin (37) of the valve needle, said intermediate pressure element can be displaced axially with the valve needle (16) in said opening (45) in the intermediate disk (14), said intermediate pressure element is guided on a circumferential side for contacting said pressure bolt (28) after traversing a pretravel axial distance, said intermediate pressure element separates said low pressure space in the intermediate disk (14) from the pressure-relieved spring chamber (25), at least one channel is provided in said intermediate pressure element which interrupts a portion of an axial contact of the pressure ring (33) against an upper surface of the intermediate pressure element (40) which permits fluid flow from said low pressure space to said pressure-relieved spring chamber, and with said pressure ring (33) against a shoulder (34) of said intermediate pressure element, fluid will flow from said low pressure chamber to said pressure-relieved spring chamber, and said channel is disposed in the intermediate element (40) such that the low-pressure chamber formed in the opening (45) communicates continuously with the spring chamber (25).

2. The fuel injection nozzle as claimed in claim 1, wherein the channel (50) is formed as a radial removal of material (51, 55) in the circumference of the pressure element.

3. The fuel injection nozzle as claimed in claim 1, wherein the channel is formed by a radial groove in an end face (41) of the intermediate pressure element (40).

4. The fuel injection nozzle as claimed in claim 1, wherein the channel is constructed as an opening which penetrates the intermediate pressure element (40).

5. The fuel injection nozzle as claimed in claim 1, wherein at least one radial groove (59) is arranged in an end face (36) of the pressure ring (33).

* * * * *